US010584441B2

(12) United States Patent
Bruno et al.

(10) Patent No.: US 10,584,441 B2
(45) Date of Patent: Mar. 10, 2020

(54) LAUNDRY TREATING APPLIANCE WITH MAGNETIC LATCH

(71) Applicant: WHIRLPOOL CORPORATION, Benton Harbor, MI (US)

(72) Inventors: Ariana M. Bruno, St. Joseph, MI (US); Arunkumar Harikrishnasamy, Stevensville, MI (US); Rachel C. Matyastik, Saint Joseph, MI (US); Jason R. Spears, Saint Joseph, MI (US); Kyle J. Sztykiel, Lansing, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 795 days.

(21) Appl. No.: 15/240,283

(22) Filed: Aug. 18, 2016

(65) Prior Publication Data

US 2018/0051408 A1 Feb. 22, 2018

(51) Int. Cl.
*D06F 58/04* (2006.01)
*D06F 59/04* (2006.01)

(52) U.S. Cl.
CPC ..... *D06F 59/04* (2013.01)

(58) Field of Classification Search
CPC .. D06F 58/04; F16B 2001/0035; E05C 19/16; H04N 1/00519
USPC .... 34/601; 312/228, 326, 321.5, 138.1, 109; 134/57 DL, 58 DL, 56 D, 58 D; 335/205
See application file for complete search history.

(56) References Cited

U.S. PATENT DOCUMENTS

| | | | | |
|---|---|---|---|---|
| 2,844,402 | A * | 7/1958 | Hughes | E05B 53/001 292/251.5 |
| 3,426,166 | A | 2/1969 | Canceill | |
| 4,211,990 | A * | 7/1980 | Gwozdz | H01H 3/162 200/61.7 |
| 4,561,130 | A * | 12/1985 | Bunngardner | A47K 13/242 16/320 |
| 5,707,091 | A * | 1/1998 | Morita | E05C 19/16 24/303 |
| 5,949,050 | A * | 9/1999 | Fosbenner | G09F 9/375 235/449 |
| 7,490,496 | B2 | 2/2009 | Kim et al. | |
| 2015/0354248 | A1 | 12/2015 | Promutico et al. | |

FOREIGN PATENT DOCUMENTS

| | | | |
|---|---|---|---|
| CN | 1536140 | A | 10/2004 |
| KR | 20030077174 | A | 10/2003 |
| KR | 20090071291 | A * | 7/2009 |
| KR | 101308634 | B1 | 9/2013 |

OTHER PUBLICATIONS

Smart Magnets for Product Design that Surprises the Senses, Polymagnet Correlated Magnets at http://www.polymagnet.com/applications/, Jan. 5, 2016; Whitepaper.

* cited by examiner

*Primary Examiner* — Edelmira Bosques
*Assistant Examiner* — Bao D Nguyen
(74) *Attorney, Agent, or Firm* — McGarry Bair PC

(57) ABSTRACT

A laundry treating appliance, such as a clothes dryer, comprises a door having a magnetic composite and a cabinet having a strike plate in order to open and close the door. The magnetic composite comprises a ferrous metal shim, a magnet, and a non-magnetic cover, having an increased magnetic field strength from the magnetic field strength of the magnet alone.

13 Claims, 5 Drawing Sheets

LAUNDRY TREATING APPLIANCE WITH MAGNETIC LATCH

BACKGROUND OF THE INVENTION

Laundry treating appliances, such as clothes washers, clothes dryers, and refreshers, may have a configuration based on a rotating drum that defines a treating chamber in which laundry items are placed for treating according to a cycle of operation. The clothes dryer may include a cabinet defined by a front wall, a rear wall, and a pair of side walls supporting a top wall. A door may be hingedly mounted to the front wall and may be selectively movable between opened and closed positions to close an opening in the front wall, which provides access to the treating chamber within the cabinet.

The door can have a latch in order to retain the door in the closed position and required a pull force to move the door to the open position. Traditionally, door latches are in the form of a strike and catch latch, which causes unappealing sounds that may colloquially be described as, for example, a "cajunk" or "clanking" noise as the door is pulled open or closed. Some users find this noise undesirable.

SUMMARY

In one aspect, a clothes dryer comprising a cabinet defining an interior and having an access opening providing access to the interior, a drum rotatably mounted within the interior, a door moveably mounted to the cabinet to selectively open/close the access opening, and a ferrous strike plate provided on one of the cabinet or the door, and a magnet composite provided on the other of the cabinet or the door and comprising a sequential stack-up of a ferrous metal shim, a magnet, and a non-magnetic cover, wherein the ferrous metal shim is adjacent the other one of the cabinet or the door and the non-magnetic cover lies between the magnet and one of the cabinet or the door when the door closes the access opening.

In another aspect, a clothes dryer comprising a cabinet defining an interior and having an access opening providing access to the interior, a drum rotatably mounted within the interior, a door hingedly mounted to the cabinet to selectively open/close the access opening, and a ferrous strike plate provided the cabinet, and a magnet composite provided on the door in registry with the strike plate and comprising a sequential stack-up of a ferrous metal shim, a magnet, and a non-magnetic cover, wherein the ferrous metal shim is adjacent the door, and the non-magnetic cover overlies the magnet and confronts the cabinet when the door closes the access opening.

DESCRIPTION OF EMBODIMENTS OF THE INVENTION

Figure 1:
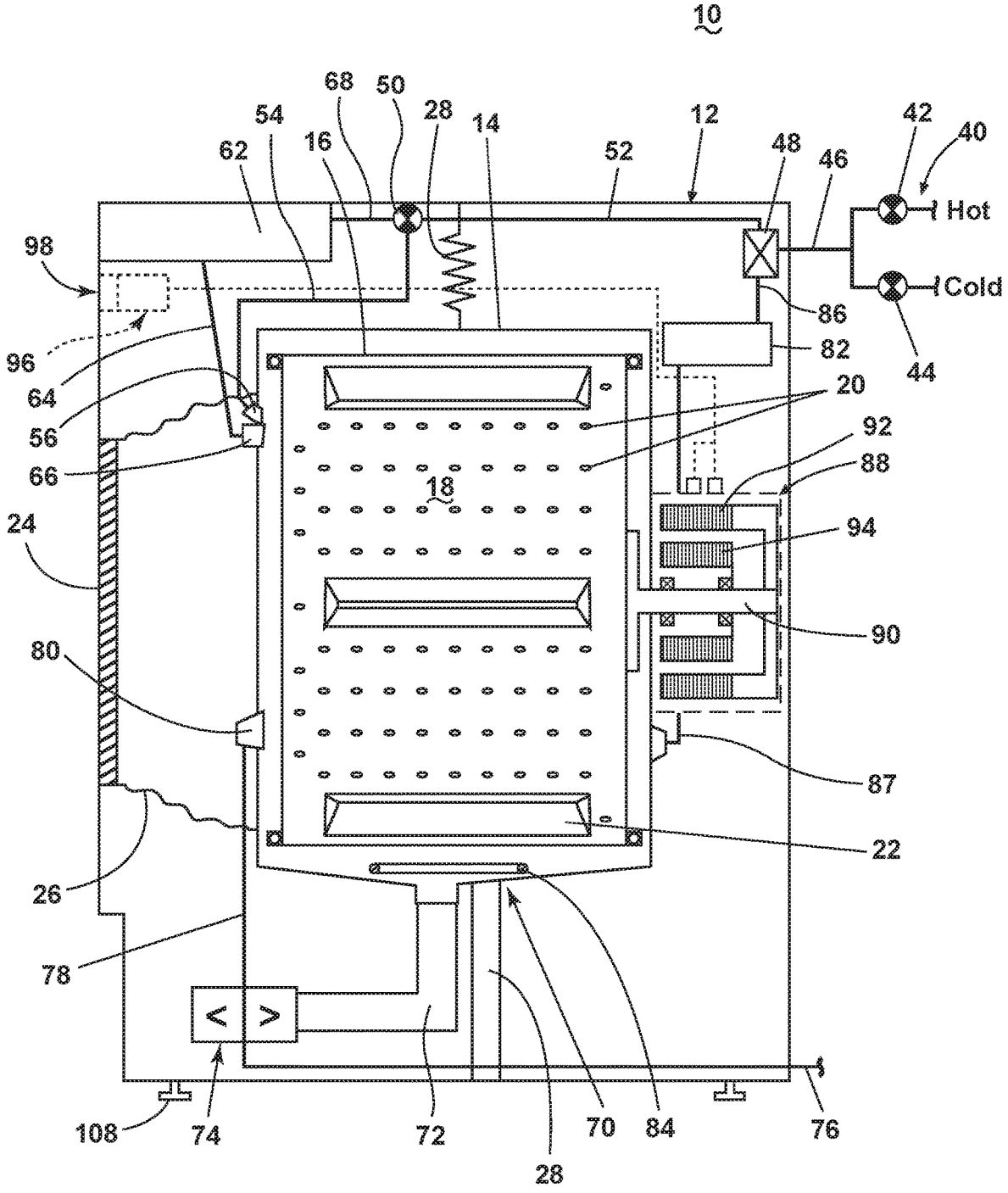
FIG. 1 is a schematic view of a laundry treating appliance in the form of a clothes dryer according to a first embodiment of the invention.

FIG. 1 is a schematic view of a laundry treating appliance 10 in the form of a clothes dryer 10 that may be controlled according to one embodiment of the invention. The clothes dryer 10 described herein shares many features of a traditional automatic clothes dryer, which will not be described in detail except as necessary for a complete understanding of the invention. While the embodiments of the invention are described in the context of a clothes dryer 10, the embodiments of the invention may be used with any type of laundry treating appliance, non-limiting examples of which include a washing machine, a combination washing machine and dryer and a refreshing/revitalizing machine.

As illustrated in FIG. 1, the clothes dryer 10 may include a cabinet 12 in which is provided a controller 14 that may receive input from a user through a user interface 16 for selecting a cycle of operation and controlling the operation of the clothes dryer 10 to implement the selected cycle of operation.

The cabinet 12 may be defined by a front wall 18, a rear wall 20, and a pair of side walls 22 supporting a top wall 24. A chassis may be provided with the walls being panels mounted to the chassis. A door 26 may be hingedly mounted to the front wall 18 and may be selectively movable between opened and closed positions to close an opening in the front wall 18, which provides access to the interior of the cabinet 12.

A rotatable drum 28 may be disposed within the interior of the cabinet 12 between opposing stationary front and rear bulkheads 30, 32, which, along with the door 26, collectively define a treating chamber 34 for treating laundry. As illustrated, and as is the case with most clothes dryers, the treating chamber 34 is not fluidly coupled to a drain. Thus, any liquid introduced into the treating chamber 34 may not be removed merely by draining.

Non-limiting examples of laundry that may be treated according to a cycle of operation include, a hat, a scarf, a glove, a sweater, a blouse, a shirt, a pair of shorts, a dress, a sock, a pair of pants, a shoe, an undergarment, and a jacket. Furthermore, textile fabrics in other products, such as draperies, sheets, towels, pillows, and stuffed fabric articles (e.g., toys), may be treated in the clothes dryer 10.

The drum 28 may include at least one lifter 29. In most dryers, there may be multiple lifters. The lifters may be located along an inner surface of the drum 28 defining an interior circumference of the drum 28. The lifters may facilitate movement of the laundry 36 within the drum 28 as the drum 28 rotates.

The drum 28 may be operably coupled with a motor 54 to selectively rotate the drum 28 during a cycle of operation. The coupling of the motor 54 to the drum 28 may be direct or indirect. As illustrated, an indirect coupling may include a belt 56 coupling an output shaft of the motor 54 to a wheel/pulley on the drum 28. A direct coupling may include the output shaft of the motor 54 coupled to a hub of the drum 28.

An air system may be provided to the clothes dryer 10. The air system supplies air to the treating chamber 34 and exhausts air from the treating chamber 34. The supplied air may be heated or not. The air system may have an air supply portion that may form, in part, a supply conduit 38, which has one end open to ambient air via a rear vent 37 and another end fluidly coupled to an inlet grill 40, which may be in fluid communication with the treating chamber 34. A heating element 42 may lie within the supply conduit 38 and may be operably coupled to and controlled by the controller 14. If the heating element 42 is turned on, the supplied air will be heated prior to entering the drum 28.

The air system may further include an air exhaust portion that may be formed in part by an exhaust conduit 44. A lint trap 45 may be provided as the inlet from the treating chamber 34 to the exhaust conduit 44. A blower 46 may be fluidly coupled to the exhaust conduit 44. The blower 46 may be operably coupled to and controlled by the controller 14. Operation of the blower 46 draws air into the treating chamber 34 as well as exhausts air from the treating chamber 34 through the exhaust conduit 44. The exhaust conduit 44 may be fluidly coupled with a household exhaust duct (not shown) for exhausting the air from the treating chamber 34 to the outside of the clothes dryer 10.

The air system may further include various sensors and other components, such as a thermistor 47 and a thermostat 48, which may be coupled to the supply conduit 38 in which the heating element 42 may be positioned. The thermistor 47 and the thermostat 48 may be operably coupled to each other. Alternatively, the thermistor 47 may be coupled to the supply conduit 38 at or near to the inlet grill 40. Regardless of its location, the thermistor 47 may be used to aid in determining an inlet temperature. A thermistor 51 and a thermal fuse 49 may be coupled to the exhaust conduit 44, with the thermistor 51 being used to determine an outlet air temperature.

A moisture sensor 50 may be positioned in the interior of the treating chamber 34 to monitor the amount of moisture of the laundry in the treating chamber 34. One example of a moisture sensor 50 is a conductivity strip. The moisture sensor 50 may be operably coupled to the controller 14 such that the controller 14 receives output from the moisture sensor 50. The moisture sensor 50 may be mounted at any location in the interior of the clothes dryer 10 such that the moisture sensor 50 may be able to accurately sense the moisture content of the laundry. For example, the moisture sensor 50 may be coupled to one of the bulkheads 30, 32 of the drying chamber 34 by any suitable means.

A dispensing system 57 may be provided to the clothes dryer 10 to dispense one or more treating chemistries to the treating chamber 34 according to a cycle of operation. As illustrated, the dispensing system 57 may be located in the interior of the cabinet 12 although other locations are also possible. The dispensing system 57 may be fluidly coupled to a water supply 68. The dispensing system 57 may be further coupled to the treating chamber 34 through one or more nozzles 69. As illustrated, nozzles 69 are provided to the front and rear of the treating chamber 34 to provide the treating chemistry or liquid to the interior of the treating chamber 34, although other configurations are also possible.

As illustrated, the dispensing system 57 may include a reservoir 60, which may be a cartridge, for a treating chemistry that is releasably coupled to the dispensing system 57, which dispenses the treating chemistry from the reservoir 60 to the treating chamber 34. The reservoir 60 may include one or more cartridges configured to store one or more treating chemistries in the interior of cartridges.

A mixing chamber 62 may be provided to couple the reservoir 60 to the treating chamber 34 through a supply conduit 63. Pumps such as a metering pump 64 and delivery pump 66 may be provided to the dispensing system 57 to selectively supply a treating chemistry and/or liquid to the treating chamber 34 according to a cycle of operation. The water supply 68 may be fluidly coupled to the mixing chamber 62 to provide water from the water source to the mixing chamber 62. The water supply 68 may include an inlet valve 70 and a water supply conduit 72. It is noted that, instead of water, a different treating chemistry may be provided from the exterior of the clothes dryer 10 to the mixing chamber 62.

The treating chemistry may be any type of aid for treating laundry, non-limiting examples of which include, but are not limited to, water, fabric softeners, sanitizing agents, de-wrinkling or anti-wrinkling agents, and chemicals for imparting desired properties to the laundry, including stain resistance, fragrance (e.g., perfumes), insect repellency, and UV protection.

The clothes dryer 10 may also be provided with a steam generating system 80 which may be separate from the dispensing system 57 or integrated with portions of the dispensing system 57 for dispensing steam and/or liquid to the treating chamber 34 according to a cycle of operation. The steam generating system 80 may include a steam generator 82 fluidly coupled with the water supply 68 through a steam inlet conduit 84. A fluid control valve 85 may be used to control the flow of water from the water supply conduit 72 between the steam generating system 80 and the dispensing system 57. The steam generator 82 may further be fluidly coupled with the one or more supply conduits 63 through a steam supply conduit 86 to deliver steam to the treating chamber 34 through the nozzles 69. Alternatively, the steam generator 82 may be coupled with the treating chamber 34 through one or more conduits and nozzles independently of the dispensing system 57.

The steam generator 82 may be any type of device that converts the supplied liquid to steam. For example, the steam generator 82 may be a tank-type steam generator that stores a volume of liquid and heats the volume of liquid to convert the liquid to steam. Alternatively, the steam generator 82 may be an in-line steam generator that converts the liquid to steam as the liquid flows through the steam generator 82.

It will be understood that any suitable dispensing system and/or steam generating system may be used with the clothes dryer 10. It is also within the scope of the invention for the dryer 10 to not include a dispensing system or a steam generating system.

Figure 2:
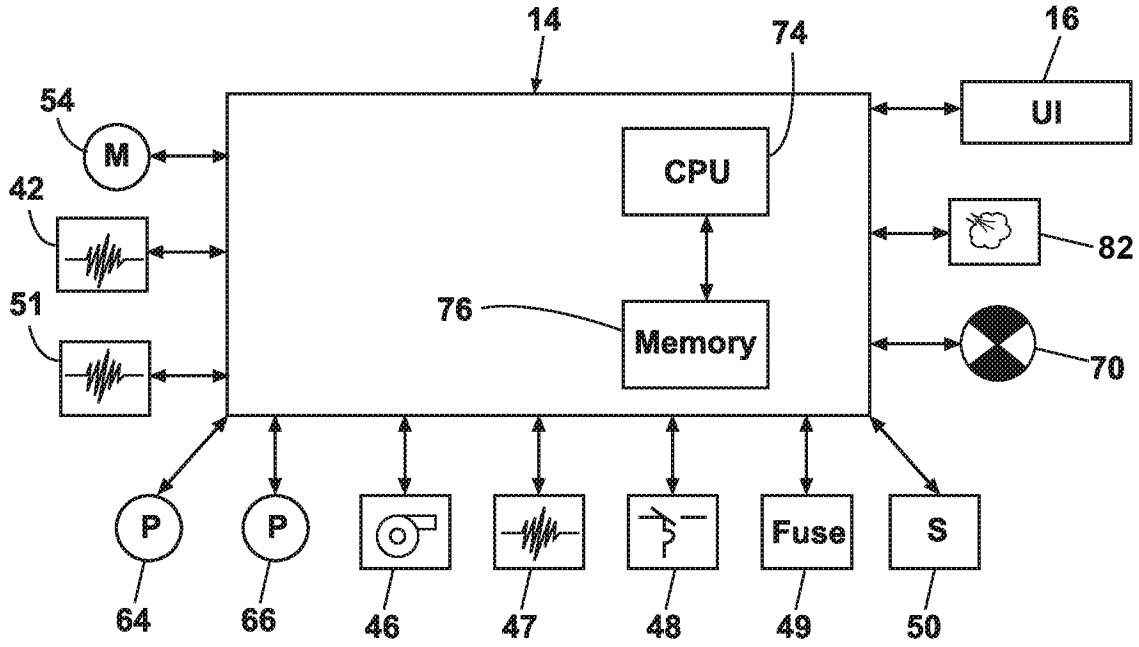
FIG. 2 is a schematic view of a controller of the clothes dryer in FIG. 1.

FIG. 2 is a schematic view of the controller 14 coupled to the various components of the dryer 10. The controller 14 may be communicably coupled to components of the clothes dryer 10 such as the heating element 42, blower 46, thermistor 47, thermostat 48, thermal fuse 49, thermistor 51, moisture sensor 50, motor 54, inlet valve 70, pumps 64, 66, steam generator 82 and fluid control valve 85 to either control these components and/or receive their input for use in controlling the components. The controller 14 is also operably coupled to the user interface 16 to receive input from the user through the user interface 16 for the implementation of the drying cycle and provide the user with information regarding the drying cycle.

The user interface 16 may be provided having operational controls such as dials, lights, knobs, levers, buttons, switches, and displays enabling the user to input commands to a controller 14 and receive information about a treatment cycle from components in the clothes dryer 10 or via input by the user through the user interface 16. The user may enter many different types of information, including, without limitation, cycle selection and cycle parameters, such as cycle options. Any suitable cycle may be used. Non-limiting examples include, Casual, Delicate, Super Delicate, Heavy Duty, Normal Dry, Damp Dry, Sanitize, Quick Dry, Timed Dry, and Jeans.

The controller 14 may implement a treatment cycle selected by the user according to any options selected by the user and provide related information to the user. The controller 14 may also comprise a central processing unit (CPU) 74 and an associated memory 76 where various treatment cycles and associated data, such as look-up tables, may be stored. One or more software applications, such as an arrangement of executable commands/instructions may be stored in the memory and executed by the CPU 74 to implement the one or more treatment cycles.

In general, the controller 14 will effect a cycle of operation to effect a treating of the laundry in the treating chamber 34, which may or may not include drying. The controller 14 may actuate the blower 46 to draw an inlet air flow 58 into the supply conduit 38 through the rear vent 37 when air flow is needed for a selected treating cycle. The controller 14 may activate the heating element 42 to heat the inlet air flow 58 as it passes over the heating element 42, with the heated air 59 being supplied to the treating chamber 34. The heated air 59 may be in contact with a laundry load 36 as it passes through the treating chamber 34 on its way to the exhaust conduit 44 to effect a moisture removal of the laundry. The heated air 59 may exit the treating chamber 34, and flow through the blower 46 and the exhaust conduit 44 to the outside of the clothes dryer 10. The controller 14 continues the cycle of operation until completed. If the cycle of operation includes drying, the controller 14 determines when the laundry is dry. The determination of a "dry" load may be made in different ways, but is often based on the moisture content of the laundry, which is typically set by the user based on the selected cycle, an option to the selected cycle, or a user-defined preference.

Figure 3:
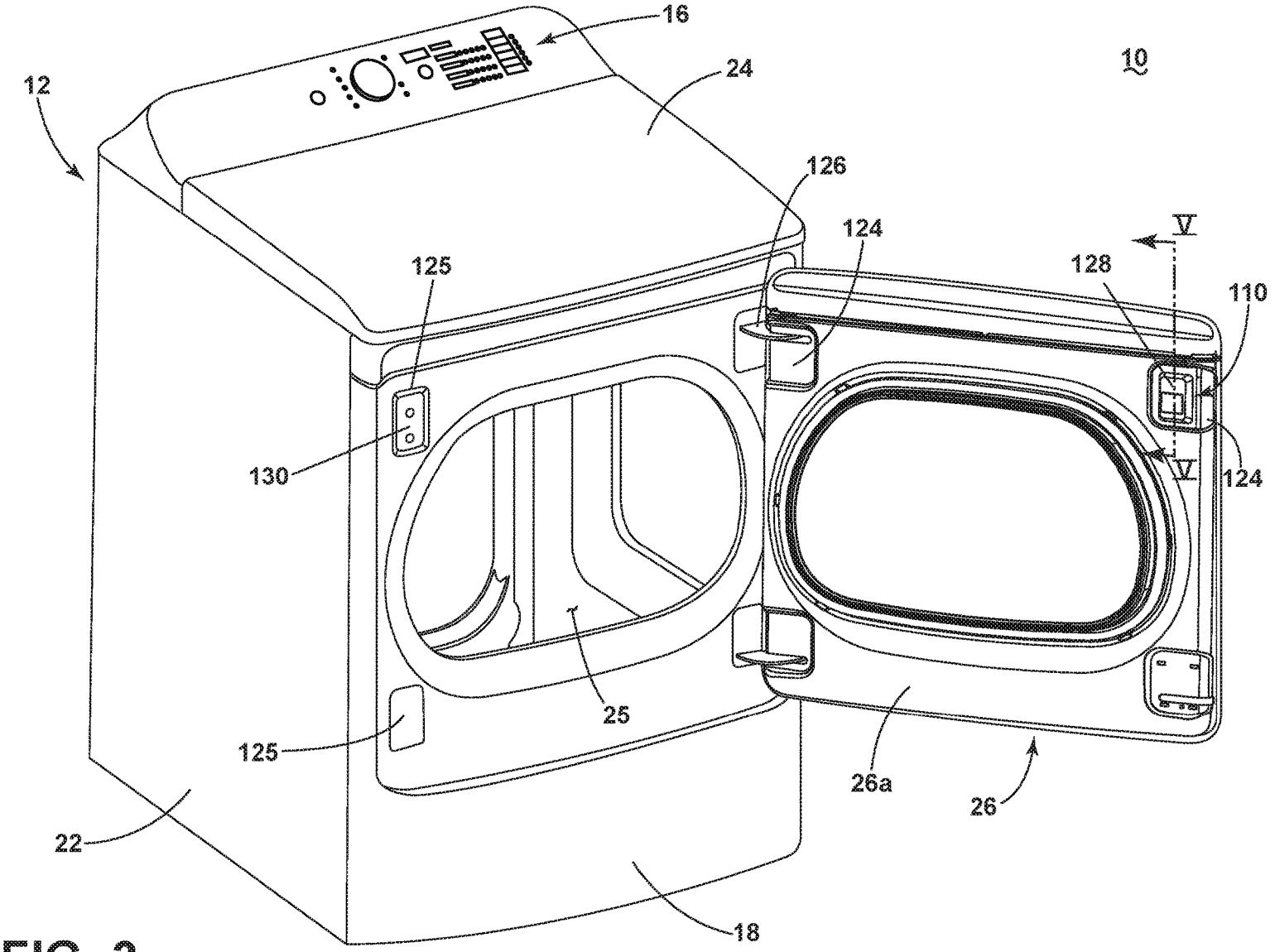
FIG. 3 is a perspective view of a laundry treating appliance in the form of a clothes dryer having a magnetic door latch according to a first embodiment of the invention.

FIG. 3 illustrates a schematic washing machine according to an embodiment of the present invention having the door 26 in the opened position. The door 26 comprises a latch in the form of a magnet composite 110 and a ferrous strike plate 130. As shown in FIG. 3, the magnet composite 110 is provided on the door 26 and the ferrous strike plate 130 is provided on the cabinet 12; however, it is also within the scope of the invention for the magnet composite 110 to be provided on the cabinet 12 and the ferrous strike plate 130 to be provided on the door 26.

The cabinet 12 can comprise hinge platforms 125 wherein the ferrous strike plate can be provided on one of the hinge platforms 125. The door 26 defines an inner surface 26*a*, which can comprise a pair of hinge platforms 124 located on opposite sides of the inner surface 26*a*. The magnet composite 110 can be located on one of the hinge platforms 124. The magnet composite 110 is in registry, or alignment, with the ferrous strike plate 130 when the door is in the closed position, or in other words closed.

Figure 4:
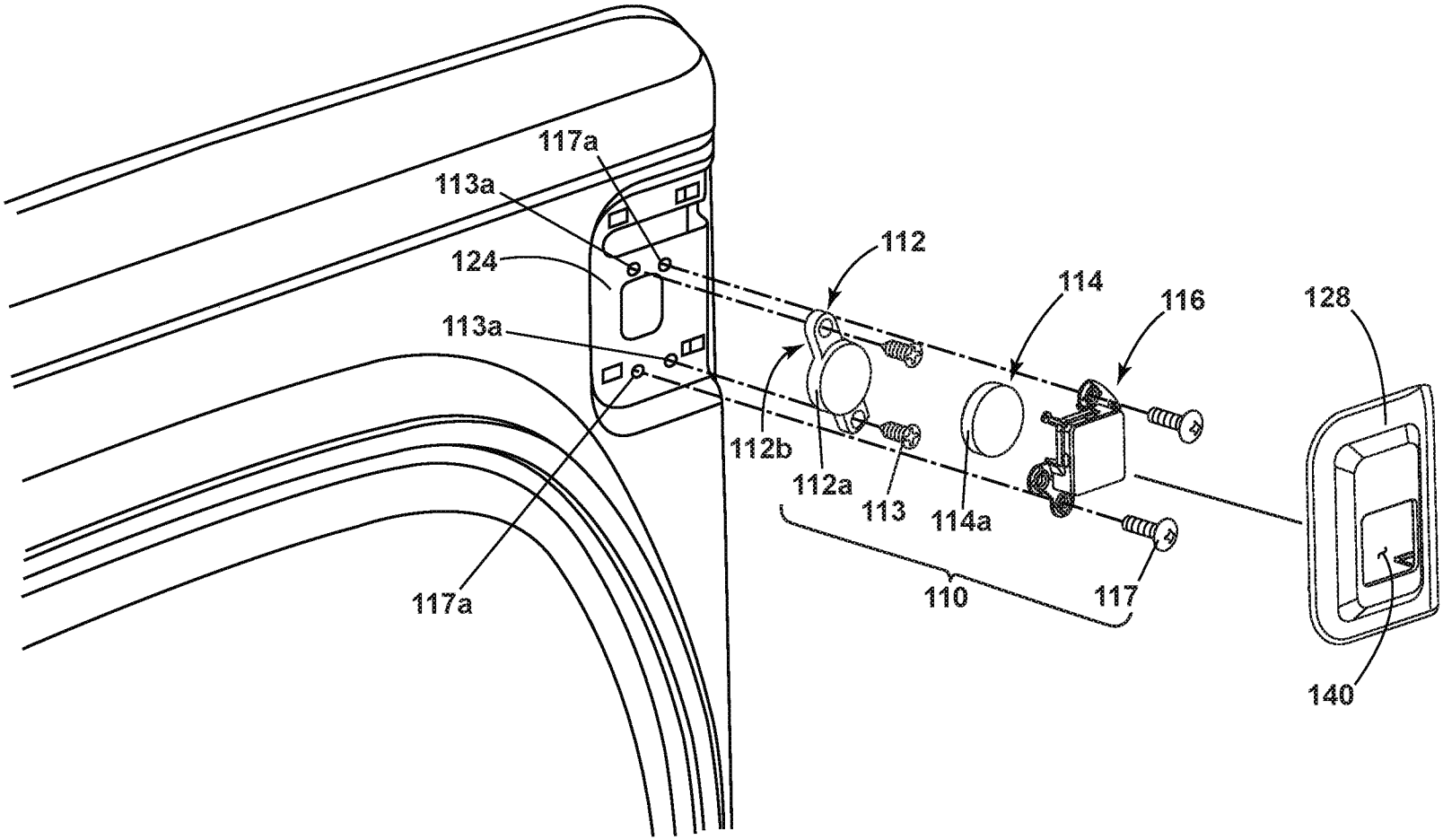
FIG. 4 is an exploded view of the magnetic door latch of FIG. 3.

A pair of hinge platforms 124 are located on opposite sides of an inner surface 26*a* of the door 26. Additionally, the inner surface 26*a* can comprise more than one pair of hinge platforms 124. The hinge platforms 124 can form a recess below the inner surface 26*a*, which is best shown in FIG. 4. The magnet composite 110 is located on one of the hinge platforms 124, and a hinge cover 128 can overlie the magnet composite 110. The hinge cover 128 can have an opening 140 that receives a portion of the non-magnetic cover 116. The other in the pair of hinge platforms 124 comprises a hinge 126 that hingedly couples the door 26 to the cabinet 12. The cabinet 12 can also comprise hinge platforms 125, wherein the ferrous strike plate 130 is provided on a hinge platform 125 and is aligned with the hinge platform 124 comprising the magnet composite 110.

As seen in FIG. 4, the magnet composite 110 comprises a sequential stack-up of a ferrous metal shim 112, a magnet 114, and a non-magnetic cover 116. The ferrous metal shim 112 is adjacent either the cabinet 12, or the door 26, dependent upon the location of the magnet composite 110. In the case that the magnet composite 110 is provided on the door 26, the ferrous metal shim 112 is adjacent the door 26. Alternatively, in the case that the magnetic composite 110 is provided on the cabinet 12, the ferrous metal shim 112 is adjacent the cabinet 12. The ferrous metal shim 112 can be mechanically fastened to the door 26 or cabinet 12 by way of screws 113 and screw holes 113*a*. While the ferrous metal shim 112 is shown to be fastened to the door 26 by way of screws 113, any suitable fastener may be used. The ferrous metal shim 112 contains iron and may be made entirely of iron, or an alloy of iron, such as stainless steel. The non-magnetic cover 116 can be mechanically fastened to the door 26 or cabinet 12 by way of screws 117 and screw holes 117*a* however, any suitable fastener may be used. The non-magnetic cover 116 can be made of plastic or any other suitable material.

The ferrous metal shim 112 and the magnet 114 both define peripheries, 112*a* and 114*a*, respectively. The height of the peripheries 112*a* and 114*a* is referred to as the thickness of the ferrous metal shim 112 and of the magnet 114. The ferrous metal shim 112 has a thickness of at least 6.50 mm and the magnet 114 has a thickness of at least 6.27 mm. The thickness of the ferrous metal shim 112 is independent of the thickness of the fastener portion 112*b*. The magnet 114 has a field strength of about 2190 gauss when measured at about 3.75 mm from the magnet 114, and the ferrous metal shim 112 adds about 400 gauss to the overall field strength of the magnet 114. The field strength can vary depending on implementation and desired holding force.

Figure 5:
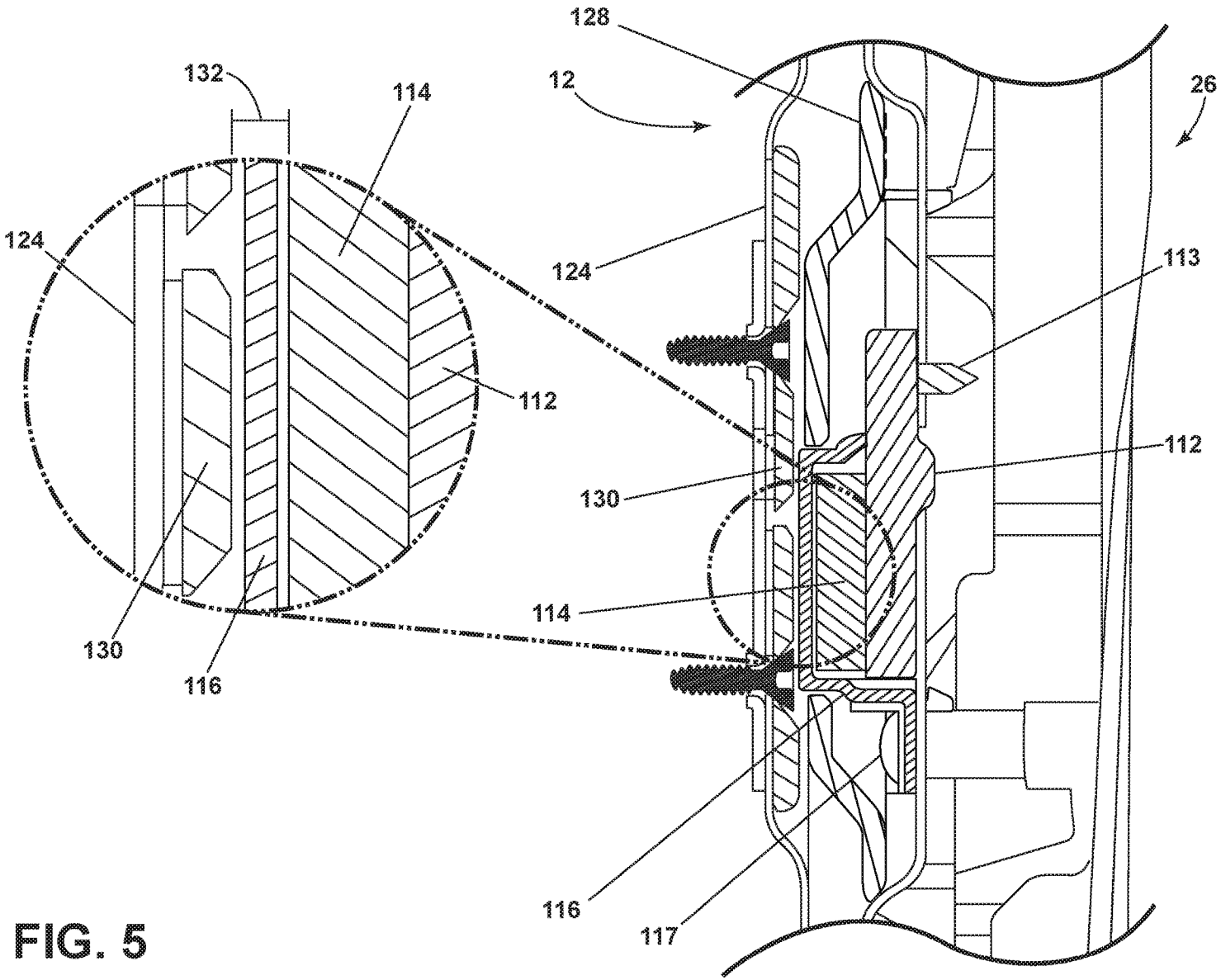
FIG. 5 is a cross-sectional view of the assembled magnetic door latch when closed along line VV in FIG. 3.

FIG. 5 illustrates a cross-sectional view of the assembled magnetic door latch when closed along line VV in FIG. 3. The non-magnetic cover 116 lies between the magnet 114 and the ferrous metal shim 112 and either the cabinet 12 or the door 26 when the door closes the access opening 25. The non-magnetic cover can overlie the magnet 114, and can completely or only partially cover the magnet 114. In the case that the magnet composite 110 is provided on the door 26, the non-magnetic cover 116 confronts, or is adjacent the cabinet 12 when the door 26 closes the access opening 25. However, when the magnet composite 110 is provided on the cabinet 12, the non-magnetic cover 116 is adjacent the door 26 when the door 26 closes the access opening 25. The non-magnetic cover 116 prevents direct contact between the magnet 114 and the ferrous strike plate 130.

A gap 132 between the ferrous strike plate 130 and the magnet 114 controls the pull force required to free the magnet composite 110 from the ferrous strike plate 130 to open the door 26. Since the non-magnetic cover 116 is not magnetic, it is considered part of the gap 132. It is contemplated that the thickness of the non-magnetic cover is in the range of 1.6-1.9 mm with the preferred thickness being 1.7 mm. The thickness of the ferrous metal shim 112 controls the gap between the magnet 114 and the ferrous strike plate 130 when the door 26 is closed. Increased thickness of the ferrous metal shim 112 results in a decreased gap 132 between the magnet 114 and the ferrous strike plate 130, while a decrease in thickness of the ferrous metal shim 112 results in an increased gap 132. It is contemplated that the desired length of the gap 132 is in the range of 0.1 mm and 0.9 mm with the preferred gap being 0.5 mm.

To open the door, a user pulls the door 26 with enough force to overcome the magnetic force between the ferrous strike plate 130 and the magnet composite 110. The combined field strength of the magnet 114 and the ferrous metal shim 112 result in a required pull force in the range of 8-14 lbs., with the average pull force being 10 lbs. The pull force can be measured directly above the magnet at a handle on the outside of the door. The combination of the magnet 114 and the ferrous metal shim 112 result in an increased field strength than that of using the magnet 114 alone since the ferrous metal shim 112 redirects magnetic flux, and less flux is lost from the magnetic field.

The magnet composite 110 causes the door 26 to be easier to close, and also causes the door to be opened and closed in a much quieter fashion, without the unappealing sounds (e.g., a "cajunk" or "clanking" noise) that would be heard in the opening and closing of a clothes dryer 10 door having a traditional strike and catch latch.

While the invention has been specifically described in connection with certain specific embodiments thereof, it is to be understood that this is by way of illustration and not of limitation, and the scope of the appended claims should be construed as broadly as the prior art will permit. It should also be noted that all elements of all of the claims may be combined with each other in any possible combination, even if the combinations have not been expressly claimed.

What is claimed is:

1. A clothes dryer comprising:

a cabinet defining an interior and having an access opening providing access to the interior;

a drum rotatably mounted within the interior;

a door moveably mounted to the cabinet by at least one hinge to selectively open/close the access opening;

a first platform recessed into an interior surface of the door and spaced apart from the at least one hinge;

a second platform provided on the cabinet such that the second platform is aligned with the first platform when the access opening is closed by the door; and a magnetic door latch assembly comprising:

a hinge cover mounted to the first platform and including an opening;

a ferrous strike plate provided on the second platform; and a magnet composite provided between the first platform and the hinge cover, comprising a sequential stack-up of a ferrous metal shim, a magnet, and a non-magnetic cover sized complementary to the opening in the hinge cover;

wherein the ferrous metal shim is adjacent the first platform, and the non-magnetic cover at least partially defines a gap between the magnet and the ferrous strike plate when the door closes the access opening, and wherein the size of the gap controls a pull force required to open the door.

2. The clothes dryer of claim 1 wherein the magnet and ferrous metal shim are sized to result in a pull force in a range of 8-14-pounds of force to overcome a magnetic force between the ferrous strike plate and the magnet composite.

3. The clothes dryer of claim 2 wherein both the ferrous metal shim and the magnet define peripheries and the periphery of the ferrous metal shim is greater than the periphery of the magnet.

4. The clothes dryer of claim 3 wherein the non-magnetic cover has a thickness in a range of 1.6-1.9 mm.

5. The clothes dryer of claim 1 wherein the magnet has a field strength of 2190 gauss.

6. The clothes dryer of claim 5 wherein the ferrous metal shim increases the field strength of the magnet by 400 gauss.

7. The clothes dryer of claim 1 wherein the non-magnetic cover completely covers the magnet.

8. The clothes dryer of claim 1 wherein the magnet composite is in registry with the ferrous strike plate when the door is closed.

9. The clothes dryer of claim 1 further comprising a hinge located on the other of the hinge platforms and hingedly coupling the door to the cabinet.

10. A clothes dryer comprising:

a cabinet defining an interior and having an access opening providing access to the interior;

a drum rotatably mounted within the interior;

a door hingedly mounted to the cabinet with at least one hinge to selectively open/close the access opening;

a first platform recessed into an interior surface of the door, spaced apart from the at least one hinge, and having one or more holes configured to receive a fastener;

a second platform provided on a wall of the cabinet such that the second platform is aligned with the first platform when the access opening is closed by the door; and a magnetic door latch assembly comprising:

a hinge cover mounted to the first platform and including an opening;

a ferrous strike plate provided on the second platform; and a magnet composite provided between the first platform and the hinge cover, in registry with the ferrous strike plate, and comprising a sequential stack-up of a ferrous metal shim having a periphery with a thickness and at least one first fastener portion configured to receive a first fastener for securing the ferrous metal shim to the first platform, a magnet having a field strength of 2190 gauss, and a non-magnetic cover having a thickness in a range of 1.6-1.9 mm, the non-magnetic cover being sized complementary to the opening in the hinge cover, and the non-magnetic cover having at least one second fastener portion configured to receive a mechanical fastener;

wherein the ferrous metal shim is adjacent the first platform and increases the field strength of the magnet by 400 gauss, the non-magnetic cover at least partially defines a gap between the magnet and the ferrous strike plate, overlies the magnet, and confronts the cabinet when the door closes the access opening, the thickness of the non-magnetic cover controls a size of the gap when the door is closed, and wherein the size of the gap controls a pull force required to overcome the field strength of the magnet and the ferrous metal shim to free the magnet composite from the ferrous strike plate.

11. The clothes dryer of claim 10 wherein a combined field strength of the magnet and ferrous metal shim results in a pull force in a range of 8-14 pounds of force to free the magnet composite from the ferrous strike plate.

12. The clothes dryer of claim 10 wherein the non-magnetic cover overlies the magnet to prevent direct contact between the magnet and the ferrous strike plate.

13. A clothes dryer comprising:

a cabinet defining an interior and having an access opening providing access to the interior;

a drum rotatably mounted within the interior;

a door moveably mounted to the cabinet by at least one hinge to selectively open/close the access opening;

a first platform recessed into an interior surface of the door, spaced apart from the at least one hinge, having a first hole configured to receive a first fastener, and a second hole configured to receive a second fastener;

a second platform provided on the cabinet such that the second platform is aligned with the first platform when the access opening is closed by the door; and a magnetic door latch assembly comprising:

a hinge cover mounted to the first platform and including an opening;

a ferrous strike plate provided on the second platform; and a magnet composite provided between the first platform and the hinge cover, comprising a sequential stack-up of a ferrous metal shim having a periphery with at least one first fastener portion configured to receive the first fastener for securing the ferrous metal shim to the first platform, a magnet, and a non-magnetic cover sized complementary to the opening in the hinge cover and having at least one second fastener portion configured to receive the second fastener for securing the non-magnetic cover to the first platform;

wherein the ferrous metal shim is adjacent the first platform, the non-magnetic cover at least partially defines a gap between the magnet and the ferrous strike plate when the door closes the access opening, and wherein the size of the gap controls a pull force required to open the door.

* * * * *